US008854186B2

(12) United States Patent
Nireki

(10) Patent No.: US 8,854,186 B2
(45) Date of Patent: Oct. 7, 2014

(54) SHEET-OF-PAPER PROCESSING DEVICE

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 728 days.

(21) Appl. No.: 13/056,516

(22) PCT Filed: Jul. 28, 2009

(86) PCT No.: PCT/JP2009/063402
§ 371 (c)(1),
(2), (4) Date: Jan. 28, 2011

(87) PCT Pub. No.: WO2010/013700
PCT Pub. Date: Feb. 4, 2010

(65) Prior Publication Data

US 2011/0140843 A1 Jun. 16, 2011

(30) Foreign Application Priority Data

Jul. 28, 2008 (JP) ..... 2008-193649

(51) Int. Cl.
*G07D 7/16* (2006.01)
*G07D 7/12* (2006.01)

(52) U.S. Cl.
CPC ... *G07D 7/16* (2013.01); *G07D 7/12* (2013.01)
USPC ..... 340/5.86

(58) Field of Classification Search
CPC ..... G07D 7/16; G07D 7/12; G05B 19/00
USPC ..... 340/5.86; 194/207; 235/379; 271/273; 382/135
See application file for complete search history.

(56) References Cited

U.S. PATENT DOCUMENTS

| | | | | |
|---|---|---|---|---|
| 5,718,318 | A | 2/1998 | Wachter | |
| 2003/0217906 | A1 * | 11/2003 | Baudat et al. | 194/207 |
| 2004/0232218 | A1 * | 11/2004 | Graham | 235/379 |
| 2009/0278307 | A1 * | 11/2009 | Skinner et al. | 271/273 |

FOREIGN PATENT DOCUMENTS

| | | |
|---|---|---|
| JP | 1 108697 | 4/1989 |
| JP | 5 12527 | 1/1993 |
| JP | 9 501248 | 2/1997 |
| JP | 2004 86678 | 3/2004 |

OTHER PUBLICATIONS

International Search Report issued Sep. 1, 2009 in PCT/JP09/063402 filed Jul. 28, 2009.

* cited by examiner

*Primary Examiner* — Edwin Holloway, III
(74) *Attorney, Agent, or Firm* — Lexyoume IP Meister, PLLC

(57) ABSTRACT

A paper sheet processing apparatus which can accurately determine whether the paper sheet is legitimate or not even if a conveyor member has a manufacturing error. The apparatus includes: a conveyor roller to convey the paper sheet inserted into an insertion slot; a paper sheet reader to read the paper sheet; a detector to detect an actual measurement value in the predetermined area along a traveling direction of the paper sheet; a storage to store a reference value of length; and an authenticity judgment part to judge the authenticity of the paper sheet based on a comparison of the actual measurement value and the reference value. The reference value is determined based on length calculated by reading a legitimate paper sheet, a theoretical value of the length in the predetermined area, and a predetermined tolerant value for a legitimate paper sheet.

3 Claims, 13 Drawing Sheets

SHEET-OF-PAPER PROCESSING DEVICE

FIELD OF THE INVENTION

The present invention relates to a sheet-of-paper processing device (or paper sheet processing apparatus) which judges an authenticity of a bill, a gift certificate, a coupon ticket, and so on (hereafter, these are collectively referred to as a paper sheet).

BACKGROUND ART

In general, a bill processing apparatus, which handles a bill as one of the embodiments of the paper sheet, is incorporated into a service device such as a game medium rental machine installed in a game hall, a vending machine or a ticket-vending machine installed in a public space, or the like which judges the authenticity of the bill inserted from a bill insertion slot by a user and provides various types of products and services in accordance with a value of the bill having been judged as authentic.

Generally, an authenticity judgment of a bill is conducted by irradiating the bill moving along the bill travelling route with light, having a light receiving sensor detect the transmitted light and reflected light from the bill, and comparing the detected data with reference data stored in dictionary data. The authenticity judgment process is performed by extracting various characteristics of a bill, and it is known that the authenticity judgment is conducted, as an example, by detecting the length of the bill.

For example, Patent Reference 1 discloses a method of judging an authenticity of a bill by determining a length of the bill, while a conveyor roller (conveyor member) to convey a bill, a pulse motor to rotationally drive this conveyor roller, and a sensor to detect the bill being conveyed along a traveling route are provided, as a product of a conveying distance per one pulse and a pulse number of the pulse motor counted during a period in which the sensor detects the bill is obtained.

[Patent Reference 1] Japanese unexamined patent application publication No. H5-12527

DISCLOSURE OF THE INVENTION

Problem to be Solved by the Invention

Meanwhile, the above-mentioned conveyor roller installed in the traveling route may have a dimensional error caused during manufacture thereof (about ±3/100 mm in the diameter). When such a dimensional error having been caused during manufacture of the conveyor roller exists in this manner, the amount of conveyance of the bill per pulse may deviate. When performing the authenticity judgment process by determining the length of the bill as described above following the predetermined program, an error may be generated in the actual length detection, and it is possible to lower the accuracy of the authenticity judgment depending on the bill processing apparatus.

Means to Solve the Problem

In the present invention, a paper sheet processing apparatus includes an insertion slot in which a paper sheet is inserted, a conveyor member which conveys the paper sheet inserted into the insertion slot, a paper sheet reading means that reads the paper sheet that is conveyed by the conveyor member, a detecting means that detects an actual measured value of the length in a prescribed area in the conveyor direction of the paper sheet that was read by the paper sheet reading means, a storage part that stores a reference value of the length in a prescribed area of the paper sheet, an authenticity judging part that judges authenticity of a paper sheet based on the comparative results between the actual measured value and the reference value; wherein, the reference value calculates the length in the prescribed region by reading the genuine paper sheet, and is determined based on the calculated length, a theoretical value that is the length of the prescribed area of the genuine paper sheet, and a pre-allowed allowance value as the genuine paper sheet relative to the theoretical value. Here, the predetermined area may include a printing area.

Further features of the present invention, its nature, and various advantages will be more apparent from the accompanying drawings and the following description of the preferred embodiment.

BRIEF DESCRIPTION OF THE DRAWINGS

FIG. 7 is a block diagram showing a configuration of control means which controls driving of driving members such as a bill conveyance mechanism, bill reading means, and the like.

DESCRIPTION OF NOTATIONS

Figure 1:
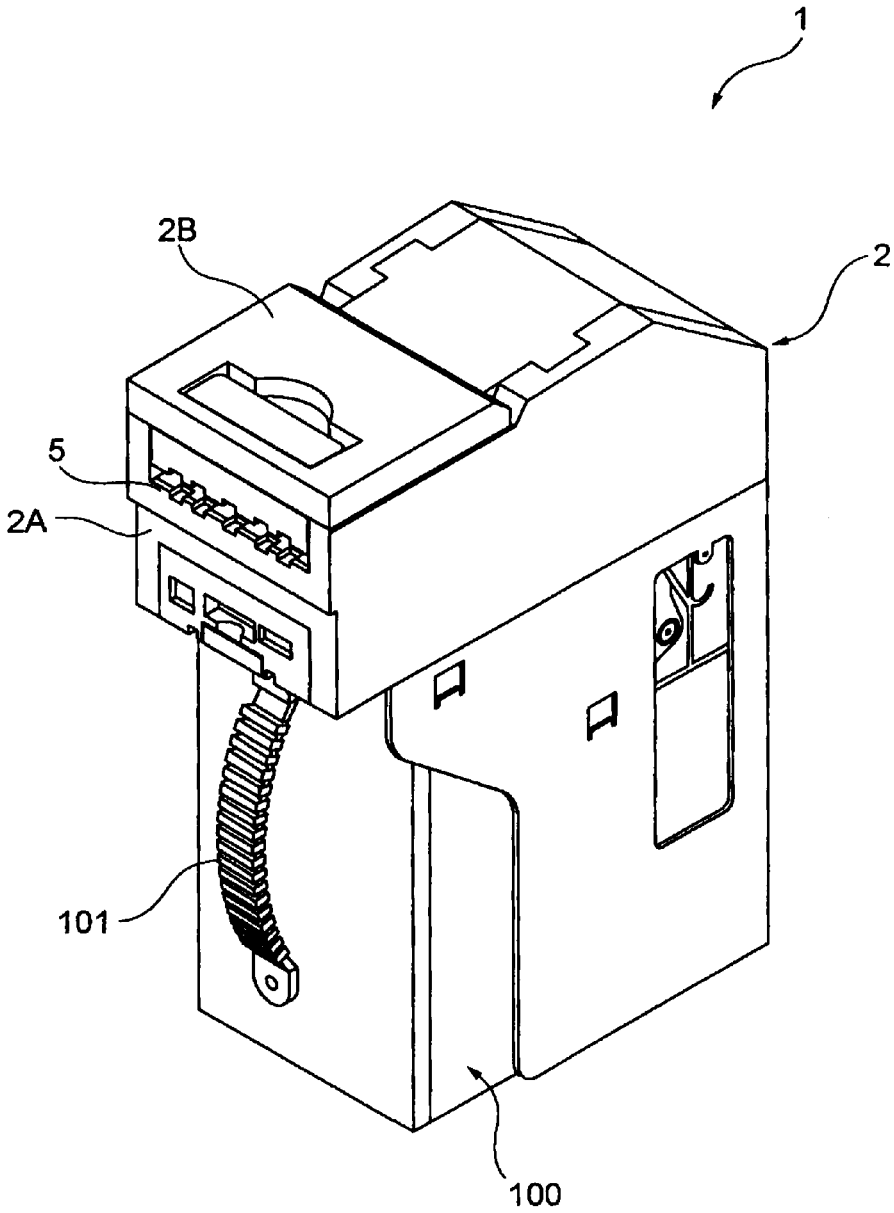
FIG. 1 is a perspective view showing an entire structure to illustrate a configuration of a bill processing apparatus of this embodiment.

1 bill processing apparatus
2 apparatus main body

3 bill traveling route
5 bill insertion slot
6 bill conveyance mechanism
8 bill reading means
10 skew correction mechanism
80 light emitting unit
80*a* first light emitting part
81 light receiving/emitting unit
81*a* light receiving part
81*b* second light emitting part
200 control means

BEST MODE FOR CARRYING OUT THE INVENTION

Hereinafter, an embodiment of the present invention will be described with reference to the drawings.

Figure 2:
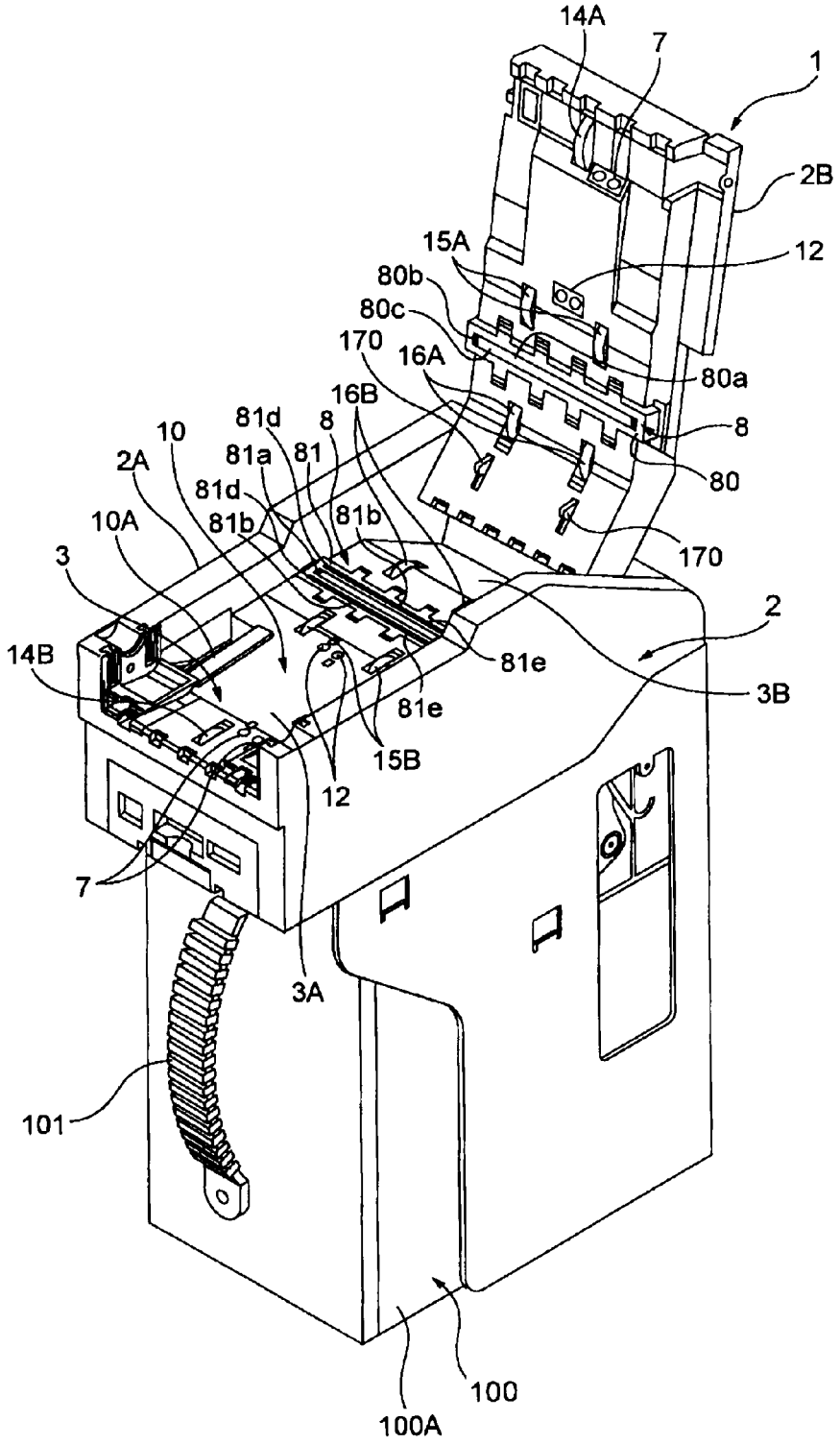
FIG. 2 is a perspective view showing the bill processing apparatus in a state that an open/close member is opened for a main body frame of an apparatus main body.
Figure 3:
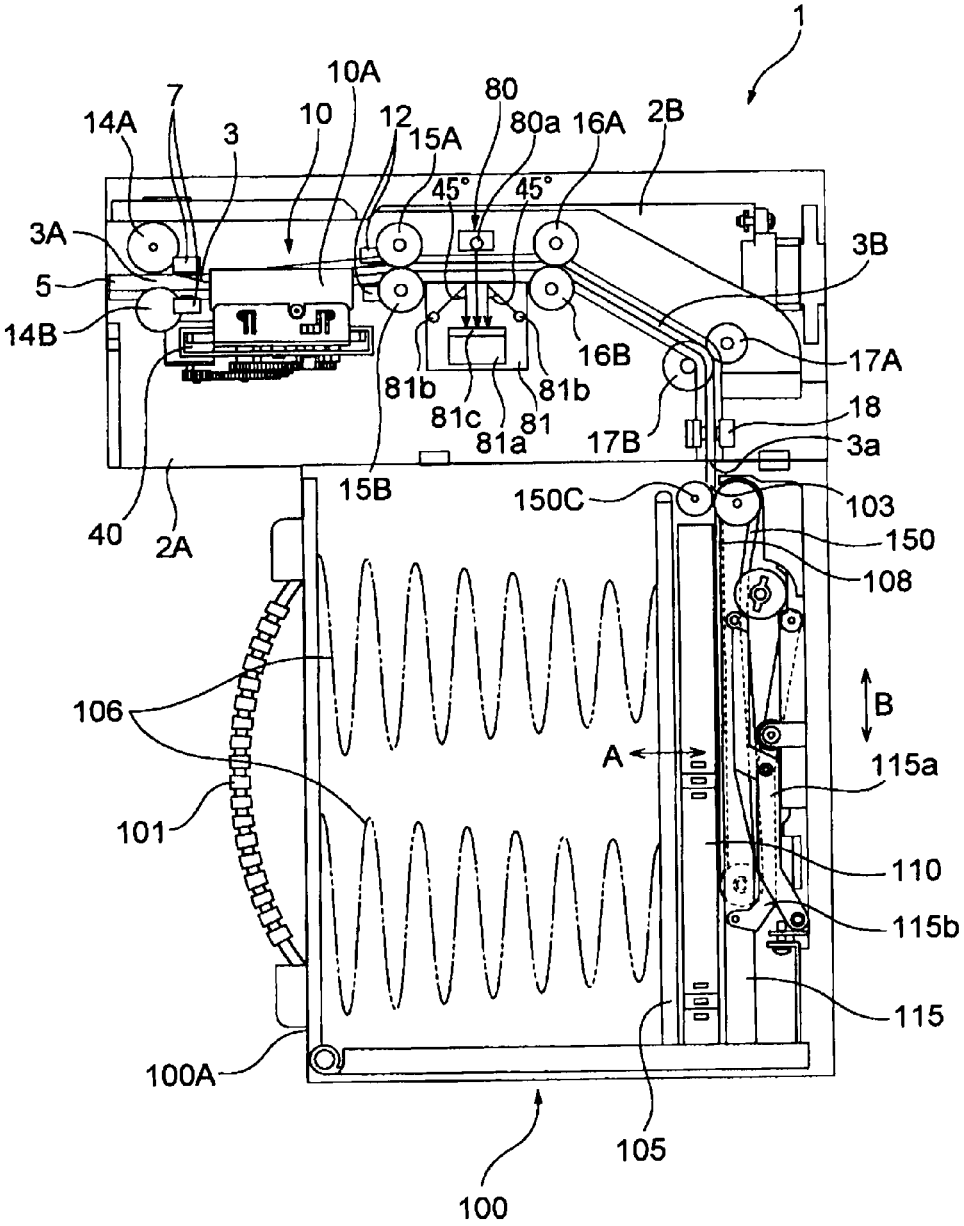
FIG. 3 is a right side view schematically showing a traveling route of a bill to be inserted from an insertion slot.
Figure 4:
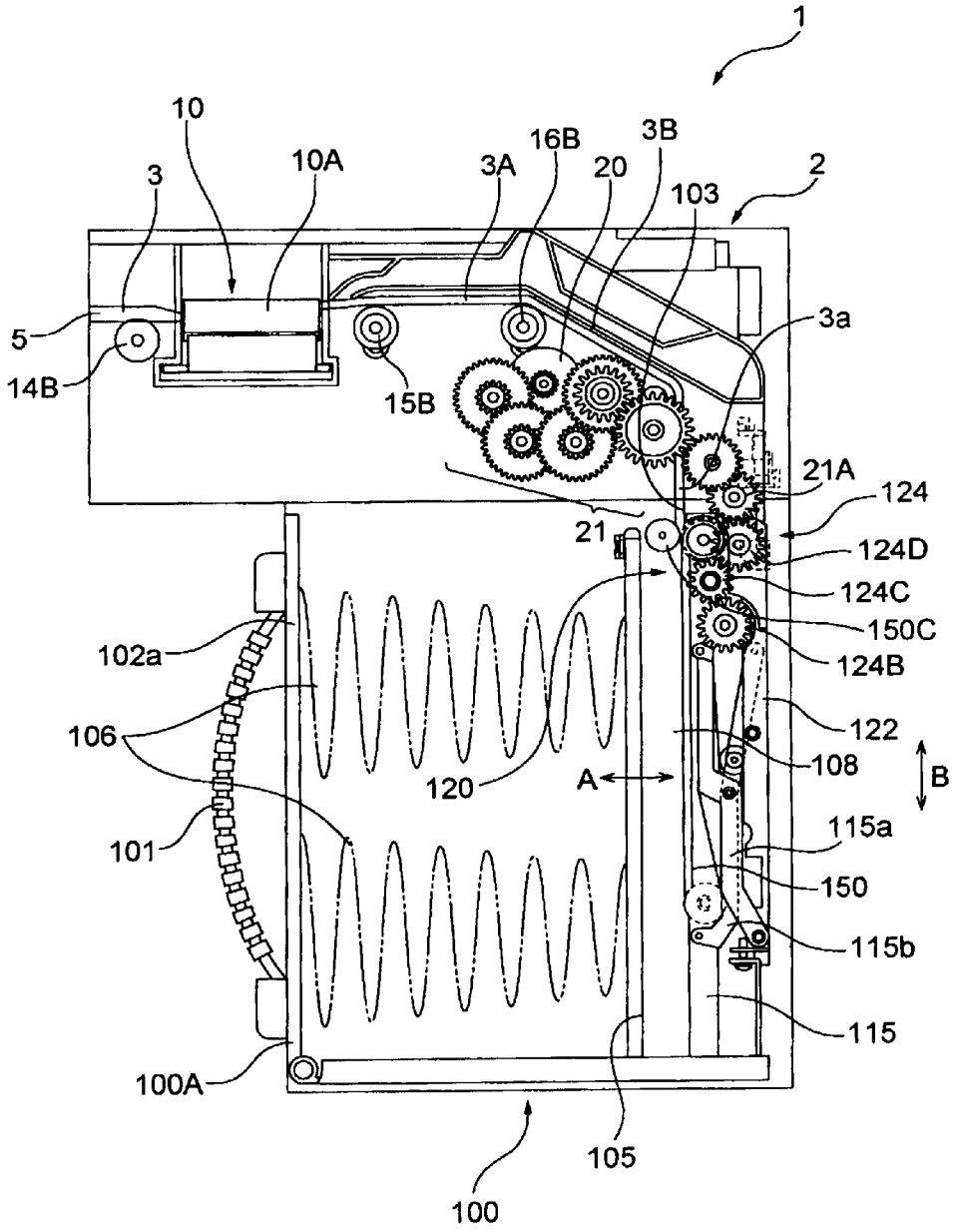
FIG. 4 is a right side view showing a schematic configuration of a power transmission mechanism for driving the presser plate arranged in a bill housing part.
Figure 5:
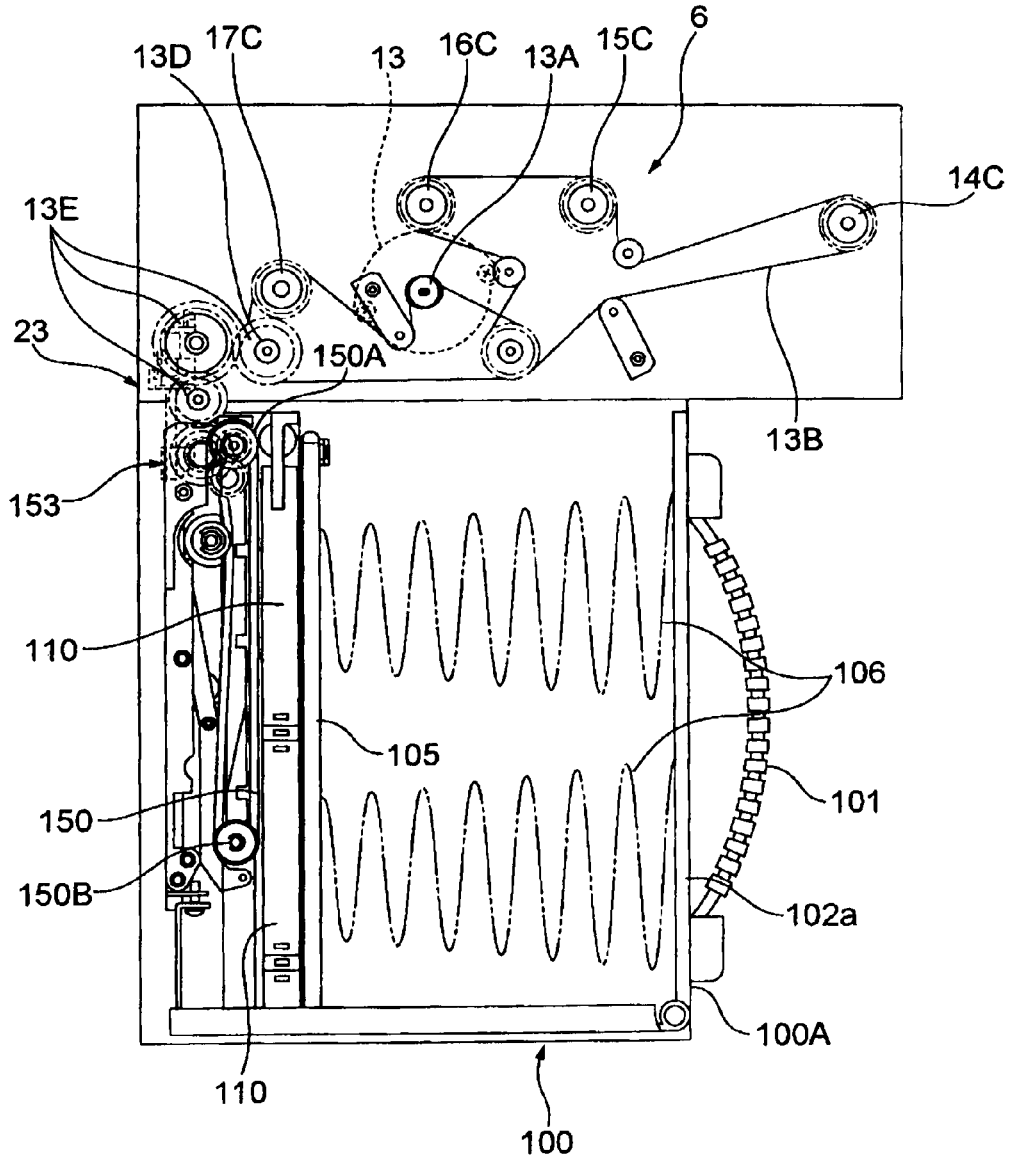
FIG. 5 is a left side view showing a schematic configuration of a driving source and a driving force transmission mechanism to drive a bill conveyance mechanism.

FIGS. 1 to 5 are diagrams showing a configuration of a bill processing apparatus according to this embodiment. FIG. 1 is a perspective view showing a general configuration thereof; FIG. 2 is a perspective view showing a state that an open/close member is opened for a main body frame of an apparatus main body; FIG. 3 is a right side view showing schematically a traveling route for a bill inserted from an insertion slot; FIG. 4 is a right side view showing schematically a power transmission mechanism for driving a presser plate installed in a bill housing part; and FIG. 5 is a left side view showing a schematic configuration of a driving source and a driving force transmission mechanism to drive a bill conveyance mechanism.

A bill processing apparatus 1 of this embodiment is so configured that it can be incorporated into, for example, various types of gaming machines such as a slot machine and the like, and the bill processing apparatus 1 includes an apparatus main body 2 and a housing part (e.g., stacker; cashbox) 100 which is provided to the apparatus main body 2 and is capable of stacking and housing a great number of bills. Here, the housing part 100 may be mountable to and demountable from the apparatus main body 2, and it is possible, for example, to remove it from the apparatus main body 2 by pulling a handle 101 provided on the front face thereof in a state that a lock mechanism (not shown) is unlocked.

As shown in FIG. 2, the apparatus main body 2 has a main frame body 2A and an open/close member 2B being configured to be opened and closed for the main body frame 2A by rotating around an axis positioned at one end thereof as a rotating center. Then, as shown in FIG. 3, the frame 2A and the open/close member 2B are configured to form a space (bill traveling route 3) through which a bill is conveyed such that both face each other across the space when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

Also, in the apparatus main body 2, a bill conveyance mechanism 6 that conveys a bill along a bill traveling route 3; an insertion detecting sensor 7 that detects the bill inserted into the bill insertion slot 5; bill reading means 8 that is installed on a downstream side of the insertion detecting sensor 7 and reads out information on the bill in a traveling sate; a skew correction mechanism 10 that accurately positions and conveys the bill with respect to the bill reading means 8; a movable piece passage detecting sensor 12 that detects that the bill passes through a pair of movable pieces constituting the skew correction mechanism; and a discharge detecting sensor 18 that detects that the bill is discharged into a bill housing part 100 are provided.

Hereafter, the respective components described above will be described in detail. The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction.

The bill conveyance mechanism 6 is a mechanism capable of conveying the bill inserted from the bill insertion slot 5 along the insertion direction, and of conveying back the bill in an insertion state toward the bill insertion slot 5. The bill conveyance mechanism 6 comprises a motor 13 (refer to FIG. 5) serving as a driving source installed in the apparatus main body 2; and conveyor roller pairs (14A and 14B), (15A and 15B), (16A and 16B), and (17A and 17B) which are installed with predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIG. 2, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 143) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is detected by the insertion detecting sensor 7.

Thus, the upper conveyor roller 14A is controllably driven to be pressed against or spaced from the lower conveyor roller 14B by a motor 70 (refer to FIG. 7) for an up-and-down movement of the roller as a driving source. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. Here, the driving source may be constituted of a solenoid or the like instead of a motor.

Further, the skew correction mechanism 10 comprises a pair of right and left movable pieces 10A (only one side is shown) such that the pair of right and left movable pieces 10A are moved to get closer with each other by driving a motor 40 for a skew driving mechanism, whereby the skew correction process is performed for the bill.

The conveyor rollers 14B, 15B, 16B and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. And when the detection signal is generated, the motor 13 is driven in a normal direction and the bill is conveyed in the insertion direction. The insertion detecting sensor 7 of this embodiment is installed between the pair of conveyor rollers (14A and 14B) and the skew correction mechanism 10 and comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a detection signal when it is detected that a front end of the bill passes through a pair of right and left movable pieces 10A constituting the skew correction mechanism 10, and when the detection signal is generated, the driving by the motor 13 is stopped such that the skew correction is made. The movable piece passage detecting sensor 12 of this embodiment is disposed on the upstream side from the bill reading means 8 and also comprises an optical sensor or a mechanical sensor in the same way as mentioned before with respect to the insertion detecting sensor.

Further, the discharge detecting sensor 18 is to detect a trailing end of the bill passing through such that it is detected that the bill is discharged into the bill housing part 100. The discharge detecting sensor 18 is disposed just in front of the receiving port 103 of the bill housing part 100 on the downstream side of the second traveling route 3B. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill conveyed in a state that the skew is eliminated by the skew correction mechanism 10, and determines the validity (authenticity). In this embodiment, the bill reading means 8, which is installed in the above-mentioned first traveling route 3A, comprises a line sensor which irradiates the bill being conveyed from top and bottom sides thereof with light such that a transmitted light and a reflected light thereof are detected by a light receiving element so as to perform reading.

In this embodiment, in order to improve the identification accuracy of the authenticity judgment, by utilizing the above-mentioned bill reading means, a first authenticity judgment process in which light is irradiated to a printed portion of a bill to be conveyed, a transmitted light and a reflected light of the irradiated light are received, and it is determined whether or not a feature point in the printed portion (an area of the feature point and a way of extracting the area are arbitrary) matches that of an authentic one; and a second authenticity judgment process in which printing lengths on the both sides of the bill (which may be printing lengths of the entire printed areas or printing lengths between feature points after extracting the feature points) are actually measured by utilizing one or both of the transmitted light and the reflected light, and it is determined whether or not the bill is an authentic one on the basis of the printing lengths on the both surfaces, are performed.

In this case, the second authenticity judgment process may be performed after the first authenticity judgment process is executed or before the first authenticity judgment process is executed. In this embodiment, as will be described later, the apparatus is configured such that the second authenticity judgment process is performed after executing the first authenticity judgment process.

The above-mentioned first and second authenticity judgment processes are performed by irradiating the light having the predetermined wavelength from the light emitting means to the printed area on the surface of the bill being conveyed, acquiring transmitted-light data of the light transmitted through the bill and reflected-light data of the light reflected by the bill, and comparing such data with the reference data of the legitimate bill having stored in advance.

In this case, since the legitimate bill has some area from which different image data are acquired depending on the wavelengths of the lights (for example, visible light or infrared light) irradiated to the area, in the first authenticity judgment process, a plurality of light sources, in consideration of this view point, irradiate different lights of different wavelengths (in this embodiment, a red light and an infrared light are irradiated) to the bill and a transmitted light therethrough and a reflected light thereon are detected such that the authenticity identification accuracy may be improved. That is, since the red light and the infrared light have different wavelengths, transmitted-light data and reflected-light data from a plurality of lights of different wavelengths may be utilized for the bill authenticity judgment whereby the judgment may use the nature that the transmittance of the transmitted light transmitted through the specific area and the reflectance of the reflected light reflected on the specific area in the legitimate bill are different from those of the counterfeit bill. Therefore, an attempt is made to further improve the bill authenticity identification accuracy by employing light sources where a plurality of wavelengths are available.

Here, since it is possible to acquire various kinds of received-light data (transmitted-light data and reflected-light data) depending on the wavelengths of the irradiated lights to the bill and the irradiated areas of the bill, although a concrete bill authenticity identification method will not be written in detail, the image appears greatly different depending on the lights in a watermark area of the bill, for example, if an image on the area is viewed with the lights of different wavelengths. Therefore, it can be considered that the bill to become an identification object is identified as the legitimate bill or the counterfeit bill by setting this portion as the specified area, acquiring transmitted-light data and reflected-light data from the specified area, and comparing such data with legitimate data from the same specified area of the legitimate bill having been stored in advance in storage means (ROM). At this time, provided that specified areas are predetermined according to the kinds of the bills, and that predetermined weighting may be applied to the transmitted-light data and the reflected-light data from this specified area, the authenticity identification accuracy may be improved.

Further, in the second authenticity judgment process, image information on the both surfaces of the bill is acquired as pixel information along the bill traveling direction for example with the above-mentioned bill reading means 8, printing lengths on the respective surfaces are derived from the pixel information along the bill traveling direction, and then an authenticity judgment process is performed based on the thus-obtained printing lengths. This second authenticity judgment process is configured to eliminate the bill having different printing lengths from those of the legitimate bill since it is identified as counterfeit, and it is possible to further improve the identification accuracy of the bill by performing such authenticity judgment process.

Meanwhile, when conducting the authenticity judgment process (the second authenticity judgment process) based on the print length of a bill, it is necessary to consider the relationships between the conveyed amount of bills and the pairs of conveyor rollers (15A, 15B), (16A, 16B), and (17A, 17B) that configure a conveyor member. In other words, the conveyor rollers of a driving side that configures the above stated conveyor roller pairs, are prepared so that the rotational driving amount is controlled by the motor (pulse motor) 13; however, it is possible for a manufacturing error to occur in any of the conveyor rollers. The manufacturing error can be considered to be about ±3/100 mm in the diameter at most, and when a manufacturing error has occurred in a conveyor roller in this manner, the rotational amount of the conveyor roller per pulse (corresponding to the bill conveyance amount) will vary. Therefore, when conducting an authenticity judgment process by determining the print length of a bill as stated above according to the pre-specified program, there is a possibility that the authenticity judgment accuracy can drop depending on the bill processing apparatus due to the error that occurred in the actual length detection.

For this purpose, the bill processing apparatus that relates to the present invention, according to a method that will be described hereinafter, is configured to change the reference value that determines a bill to be genuine with regard to the print length prior to operating the bill processing apparatus. More specifically, by configuring the ability to change the reference value for each apparatus, it becomes possible to execute an authenticity judgment process based on the length (print length) properly even when the bill processing apparatus contains a conveyor roller that generates a manufacturing error as stated above.

Then, since the above-mentioned bill reading means 8 is, to be described later, configured to perform the lighting control of the light emitting part with a predetermined interval and to comprise the line sensor which detects the transmitted light and the reflected light as the bill passes through, it is possible to acquire the image data based on the plurality of pieces of pixel information in a predetermined size as a unit by the line sensor.

In this case, the image data acquired by the line sensor is converted into data including color information having brightness for each pixel by a converter, which will be described later. In addition, the color information for each pixel having brightness to be converted by the converter corresponds to a brightness value and, for example, a numerical value from 0 to 255 (0: black to 255: white) is allocated to each pixel as information of one byte according to its brightness.

Therefore, in the first authenticity judgment process, the predetermined area of the bill is extracted; the pixel information contained in the area and the pixel information in the same area of the legitimate bill are used so as to be substituted into an appropriate correlating equation; and then a coefficient of correlation is obtained by carrying out an operation thereof, thereby enabling the authenticity identification judgment by the coefficient. Or, in addition to the above description, analog waveforms, for example, may be generated from the transmitted-light data and the reflected-light data, and the respective shapes of those waveforms may be compared with each other, whereby the authenticity identification may be judged by such comparison.

Further, in the second authenticity judgment process, it is possible to obtain length data (actual measurement data) about the printed area from the image information acquired from both surfaces of the bill. In this case, as the image data acquired as the pixel information, one pixel, for example, may have a resolution of 0.508 mm or so in the longitudinal direction of the bill, depending on the resolution of the line sensor, and therefore, it is possible to eliminate what has the printing length different from the reference at least by 1 to 2 mm or so when the printing length is obtained from the total number of pixels in the traveling direction of the bill. Moreover, the reference value that determines bills to be genuine is set in each bill processing apparatus by a prescribed operation prior to the apparatus operating as described above.

In addition, in order to further improve the identification accuracy based on the printing length, the resolution of the line sensor may be improved, but if the identification accuracy is made too high, it is possible to eliminate what has a slight manufacturing error simply in printing such that it may be considered that the above-mentioned resolution is good enough.

Here, the configuration of above-mentioned reading means 8 will be described in detail with reference to FIGS. 2 and 3.

The above-mentioned bill reading means 8 has a light emitting unit 80 which is installed on the side of the open/close member 2B and provided with a first light emitting part 80*a* capable of irradiating the upper side of the bill to be conveyed with the infrared light and the red light, and a light receiving/emitting unit 81 which is installed on the side of the main body frame 2A (a combination of a light emitting unit 80 and a light receiving/emitting unit may be referred to as a reading unit).

The light receiving/emitting unit 81 has a light receiving part 81*a* which is provided with a light receiving sensor facing the first light emitting part 80*a* across the bill and second light receiving parts 81*b* which are installed adjacently on the both sides of the light receiving part 81*a* along the bill traveling direction and are capable of irradiating the object with the infrared light and the red light.

The first light emitting part 80*a* disposed to face the light receiving part 81*a* works as a light source for the transmissive light. This first light emitting part 80*a* is, as shown in FIG. 2, comprised of a rectangular bar-like body made of synthetic resin which emits the light guided through a light guiding body 80*c* provided inside from an LED element 80*b* fixed to one end of the bar-like body. The first light emitting part having such a configuration is linearly installed in parallel with the light receiving part 81*a* (light receiving sensor) so as to be capable of entirely and equally irradiating the entire (or whole) range in the width direction of the traveling route of the bill to be conveyed although the configuration is simple.

The light receiving part 81*a* of the light receiving/emitting unit 81 is formed in a thin-walled plate shape having a band shape extending in a lateral direction of the bill traveling route 3 and having a width to an extent that the sensitivity of the light receiving sensor (not shown) provided in the light receiving part 81*a* is not affected. In addition, the light receiving sensor is configured as a so-called line sensor in which a plurality of CCDs (Charge Coupled Devices) are provided linearly at the center in the thickness direction of the light receiving part 81*a*, and a GRIN lens array 81*c* is disposed linearly above these CCDs so as to collect the transmitted light and the reflected light. Therefore, it is possible to receive the transmitted light or the reflected light of the infrared light or the red light emitted from the first light emitting part 80*a* or the second light emitting parts 81*b* such that the bill serving as the object for authenticity judgment is irradiated with the infrared light or the red light, and generate contrasting density data according to its brightness (pixel data including color information having brightness and assigned to a predetermined size as a unit) as the received-light data and a two-dimensional image based on the contrasting density data.

The second light emitting part 81*b* of the light receiving/emitting unit 81 works as a light source for the reflection light. This second light emitting part 81*b* is, in a similar manner as the first emitting part 80*a*, comprised of a rectangular bar-like body made of synthetic resin which emits the light guided through a light guiding body 81*e* provided inside from an LED element 81*d* fixed to one end of the bar-like body. The second light emitting part 81*b* is also configured to be linearly installed in parallel with the light receiving part 81*a* (line sensor).

The second light emitting parts 81*b* are capable of irradiating the bill with the light at an elevation angle of 45 degrees, for example, and are so installed that the light receiving part 81*a* may receive the reflected light from the bill. In this case, the lights irradiated to the bill by the second light emitting parts 81*b* are to be made incident at 45 degrees onto the light receiving part 81*a*, but the incident angle is not limited to 45 degrees such that the arrangement may be re-arranged as appropriate as long as the lights are irradiated evenly without shading to the surface of the bill. Therefore, the arrangement of the second light emitting parts 81*b* and the light receiving part 81*a* may be appropriately changed in design in accordance with the structure of the bill processing apparatus. Further, the second light emitting parts 81*b* are disposed on the both sides of the light receiving part 81*a* so as to be disposed across the light receiving part 81*a* and irradiate the bill with the respective lights at respective incident angles of 45 degrees. This is because, in the case where the surface of the bill has scratches or folded wrinkles, and in the case where the light is irradiated only from one side to an uneven surface generated by these scratches or folded wrinkles, it is unavoidable to make some portions shaded to cause shadow in the uneven surface. Therefore, it is prevented that the shadow is made in the portion of the uneven surface by irradiating the bill with the lights from the both sides, whereby the image data to be acquired can have a higher degree of accuracy than that of the single side irradiation. However, the second light emitting part 81*b* may be installed only on one side to configure the apparatus.

In addition, the configuration, the arrangement, and the like of the light emitting unit 80 and the light receiving/emitting unit 81 as described above are not limited to those described in this embodiment, and may be modified as appropriate.

Figure 6:
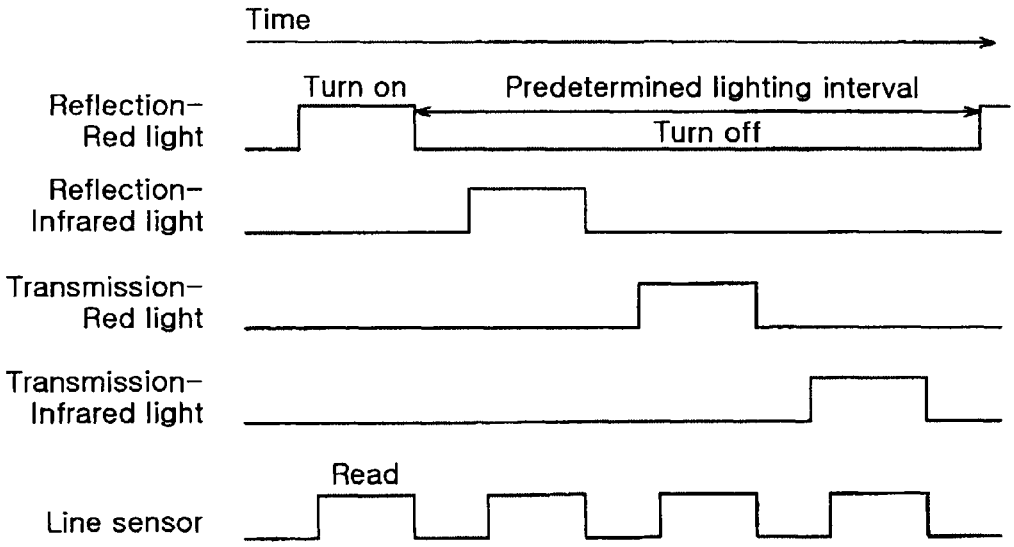
FIG. 6 shows a timing diagram illustrating a lighting control of a light emitting part when the bill is read, which indicates the lighting control of the light emitting part in the bill reading means.

Further, in the respective first light emitting part 80*a* and second light emitting part 81*b* in the above-described light emitting unit 80 and the light receiving/emitting unit 81, when the bill is read, as shown in a timing diagram of FIG. 6, an infrared light and a red light are controlled to be turned on and off with predetermined intervals. That is, the lighting control is performed such that the four light sources constituted of the transmitting light sources of the red light and the infrared light and the reflecting light sources of the red light and the infrared light in the first light emitting part 80*a* and the second light emitting parts 81*b* repeatedly turn on and off the lights with a constant interval (predetermined lighting interval), and two or more of the light sources do not simultaneously turn on the lights without overlapping the on-phases of the respective light sources in any case. In other words, lighting control is performed such that, while any one light source is turned on, the other three light sources are turned off. Thereby, as described in this embodiment, it is possible even for the one light receiving part 81*a* to detect each light from each light source at a constant interval such that pixel data having brightness in a printing area of a bill can be acquired by transmitted and reflected light of infrared light and transmitted and reflected light of red light, and that it is possible to measure the printing lengths of both surfaces. In this case, it is also possible to improve the resolution by controlling the lighting interval to be made shorter.

The bill housing part 100 which houses the above-described bill and the like is so configured as to stack and house sequentially bills identified as genuine by the bill reading means 8.

As shown in FIGS. 3 to 5, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

Further, protruding walls are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls take a holding role to stably hold the stacked bills by hitting and contacting both sides of a surface of an uppermost bill M1 of the stacked bills.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position). In this case, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 3 and 4, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 4, a housing part side gear train 124 constituting the presser plate driving mechanism 120 is connected to the pinion. For this case, as shown in FIG. 4, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

As described above, when the bill is inserted into the inside via the bill insertion slot 5, the bill is moved inside the bill traveling route 3 by the bill conveyance mechanism 6. As shown in FIG. 3, the bill traveling route 3 has the first traveling route 3A which is extended from the bill insertion slot 5 toward the back side, and the second traveling route 3B which is extended from the first traveling route 3A toward the downstream side and is inclined at a predetermined angle to the first traveling route 3A. A shutter member 170 that prevents the bill from being conveyed toward the bill insertion slot 5 by a fraudulent activity is installed in the second traveling route 3B.

Next, control means 200 that controls the driving of the bill conveyance mechanism 6, the bill reading means 8 and the like as mentioned above will be described with reference to a block diagram of FIG. 7.

Figure 7:
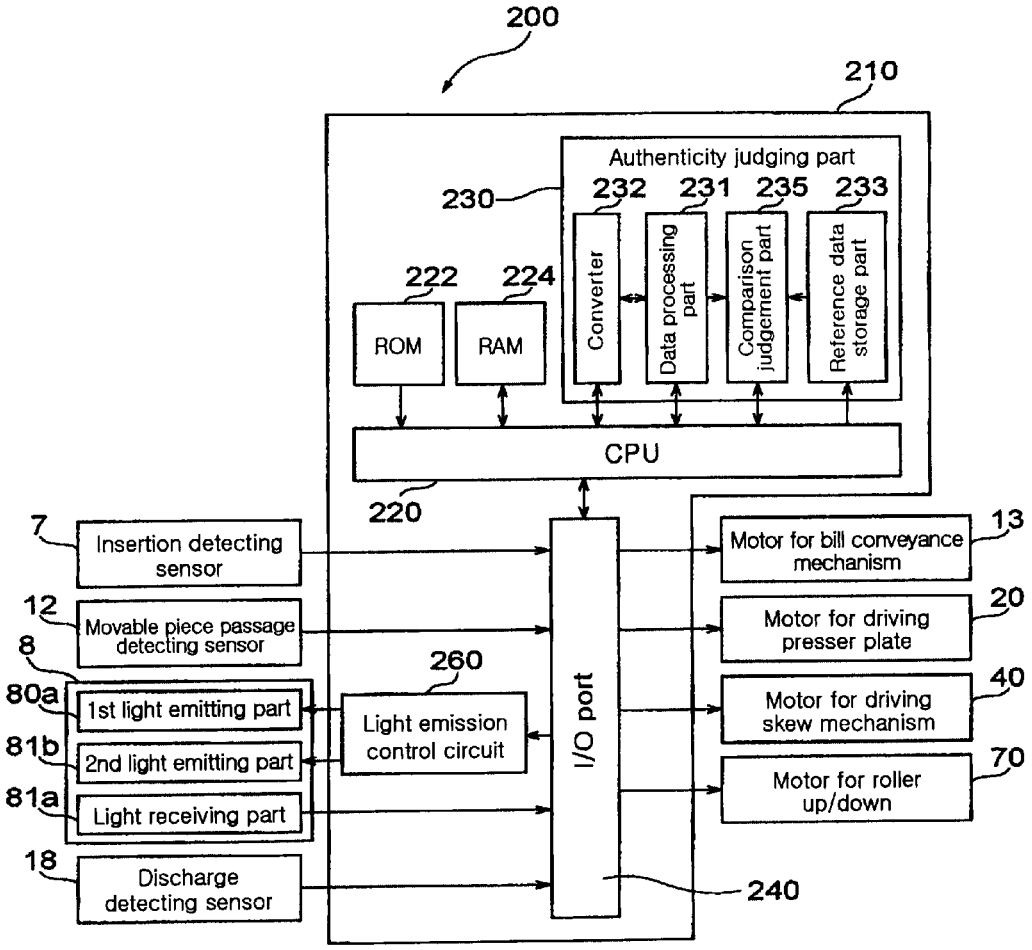

The control means 200 as shown in a block diagram of FIG. 7 comprises a control board 210 which controls the operations of the above-described respective drive units, and a CPU (Central Processing Unit) 220 controlling driving of each drive unit and constituting the bill identification means, a ROM (Read Only Memory) 222, a RAM (Random Access Memory) 224, and an authenticity judging part 230 are implemented on the control board 210.

In the ROM 222, permanent data such as various types of programs such as an authenticity judgment program in the authenticity judging part 230, operation programs for the respective drive units such as the motor 13 for the bill conveyance mechanism, the motor 20 for the presser plate, the motor 40 for the skew correction mechanism, and the roller up-and-down motor 70 for lifting up and down rollers, and the like are stored. Further, a program for processing a change to a reference value that relates to the print length of a prespecified bill to a new reference value by feeding a legitimate bill is stored in the ROM 222 as descried hereinafter.

The CPU 220 operates according to the programs stored in the ROM 222, and carries out input and output of the signals with respect to the respective drive units described above via an I/O port 240, so as to perform the entire operational control of the bill processing apparatus. That is, the motor 13 for the bill conveyance mechanism, the motor 20 for the presser plate, the motor 40 for the skew correction mechanism, and the roller up-and-down motor 70 are connected to the CPU 220 via the I/O port 240, and the operations of these drive units are controlled by control signals transmitted from the CPU 220 in accordance with the operation programs stored in the ROM 222.

Further, the CPU 220 is so configured that detection signals from the insertion detecting sensor 7, the movable piece passage detecting sensor 12, and the base part detecting sensor 18 are input into the CPU 220 via the I/O port 240, and the driving of the respective drive units is controlled based on these detection signals. Moreover, the CPU 220 is so configured that a detection signal based on a transmitted light and a reflected light of the light which is irradiated to the identification object is input into the CPU 220 via the I/O port 240 from the light receiving part 81*a* in the bill reading means 8 as described.

Moreover, the CPU 220 is configured to be connected to the first light emitting part 80*a* and the second light emitting part 81*b* in the aforementioned bill reading means 8 via the I/O port 240. The first light emitting part 80*a* and the second light emitting parts 81*b* are controlled through a light emission control circuit 260 by a control signal from the CPU 220 in accordance with the operation programs stored in the abovementioned ROM 222 such that the lighting interval and the turning-off are controlled.

The RAM 224 temporarily stores data and programs used for the CPU 220 to operate, and also acquires and temporarily stores the received light data (image data constituted of a plurality of pixels) of the bill serving as the identification object.

The authenticity judging part 230 has a function to carry out the above-mentioned first authenticity judgment process and second authenticity judgment process with respect to a bill to be conveyed so as to identify the authenticity of the bill. The authenticity judging part 230 has a converter 232 which converts the received light data of the identification object stored in the RAM 224 into pixel information containing color information having brightness for each pixel, and a data processing part 231 having a function to process image data of the bill acquired from a reflected light and a transmitted light such that printing lengths of a conveyed bill are specified, or a correction process as will be described later is carried out on the basis of the printing lengths based on the pixel information converted by the converter 232.

Further, the authenticity judging part 230 has a reference data storage part 233 in which the reference data of the legitimate bill is stored, and a comparison judgment part 235 which compares comparison data, on which various types of data processes of a bill serving as an authenticity identification object are executed in the data processing part 231, with the reference data stored in the reference data storage part 233, so as to perform an authenticity judgment process. In this case, the reference data storage part 233 stores image data about the legitimate bill to be used when the above-mentioned first authenticity judgment process is carried out, reference values of the printing lengths of the legitimate bill to be used in the above-mentioned second authenticity judgment process, the allowable range data acceptable from the reference values, and so on. In addition, the reference data is stored in the dedicated reference data storage part 233. However, the data may be stored in the above-mentioned ROM 222 and RAM 224.

The reference data storage part 233 in the authenticity judgment part 230 is able to overwrite a reference value that relates to the print length regarding a legitimate bill from among the reference data. The overwrite process of this reference value, as described hereinafter, is performed by feeding a legitimate bill (a paper that acts as a reference is also acceptable) and taking an actual measurement of the print length prior to operating the bill processing apparatus.

Here, the overwrite process of the reference value (the setting process of the new reference value) that is referred to when performing the second authenticity judgment process will be described in greater detail.

As described above, the bill reading means 8 irradiates the bill conveyed by the bill conveyance mechanism 6 with lights (red light and infrared light) from the first light emitting part 80*a* and the second light emitting parts 81*b*, and receives a transmitted light or a reflected light therefrom with the light receiving part (line sensor) 81*a*, so as to execute the reading of the bill. It is possible to acquire many pieces of pixel information for a predetermined size of pixel as a unit (for example, one pixel is 0.508 mm in the traveling direction) while the conveyance processing of the bill is conducted in the reading process, and the image data constituted of many pixels (plural pixels) acquired in this way is stored in a RAM 224. In addition, here, the image data constituted of many pixels being stored is converted into information including color information having brightness (color information to which a numerical value from 0 to 255 (0: black to 255: white) corresponding to each brightness is allocated) for each pixel by the converter 232.

Figure 8:
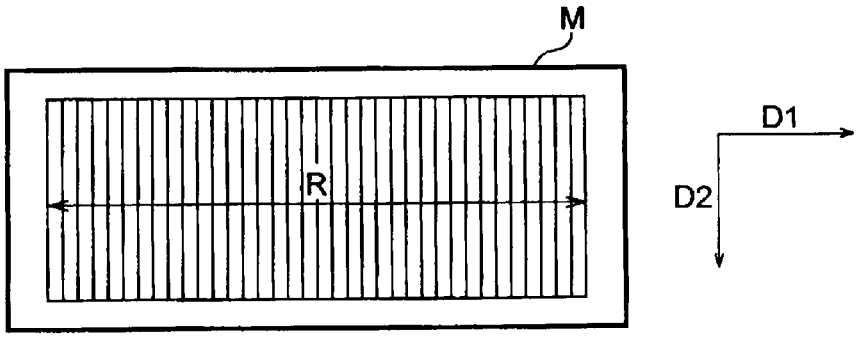
FIG. 8 is a schematic diagram illustrating a range where length data of a printed area of the bill is acquired.
Figure 9:
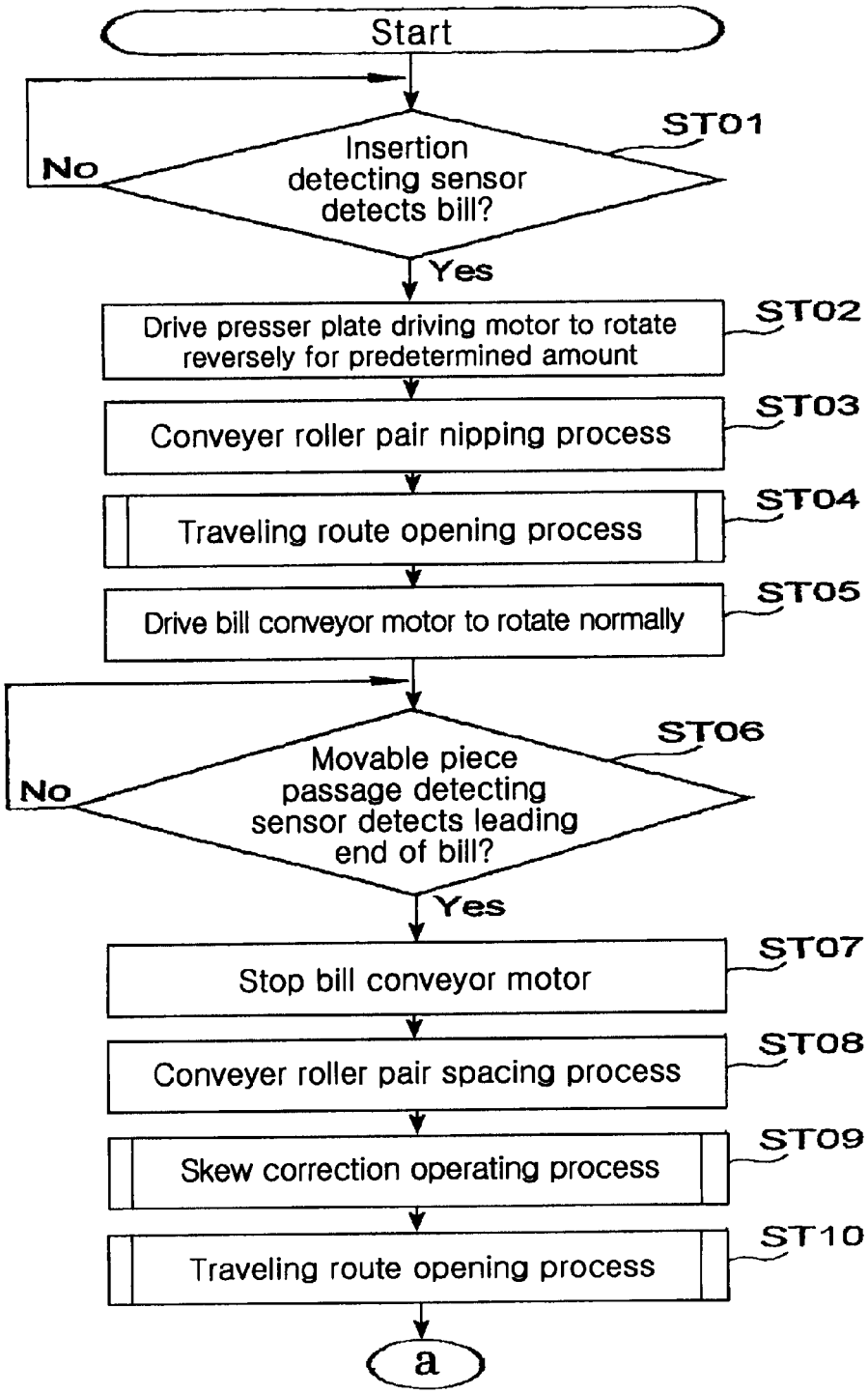
FIG. 9 shows a flowchart (part one) illustrating processing operations for processing the bill in the bill processing apparatus of this embodiment.
Figure 10:
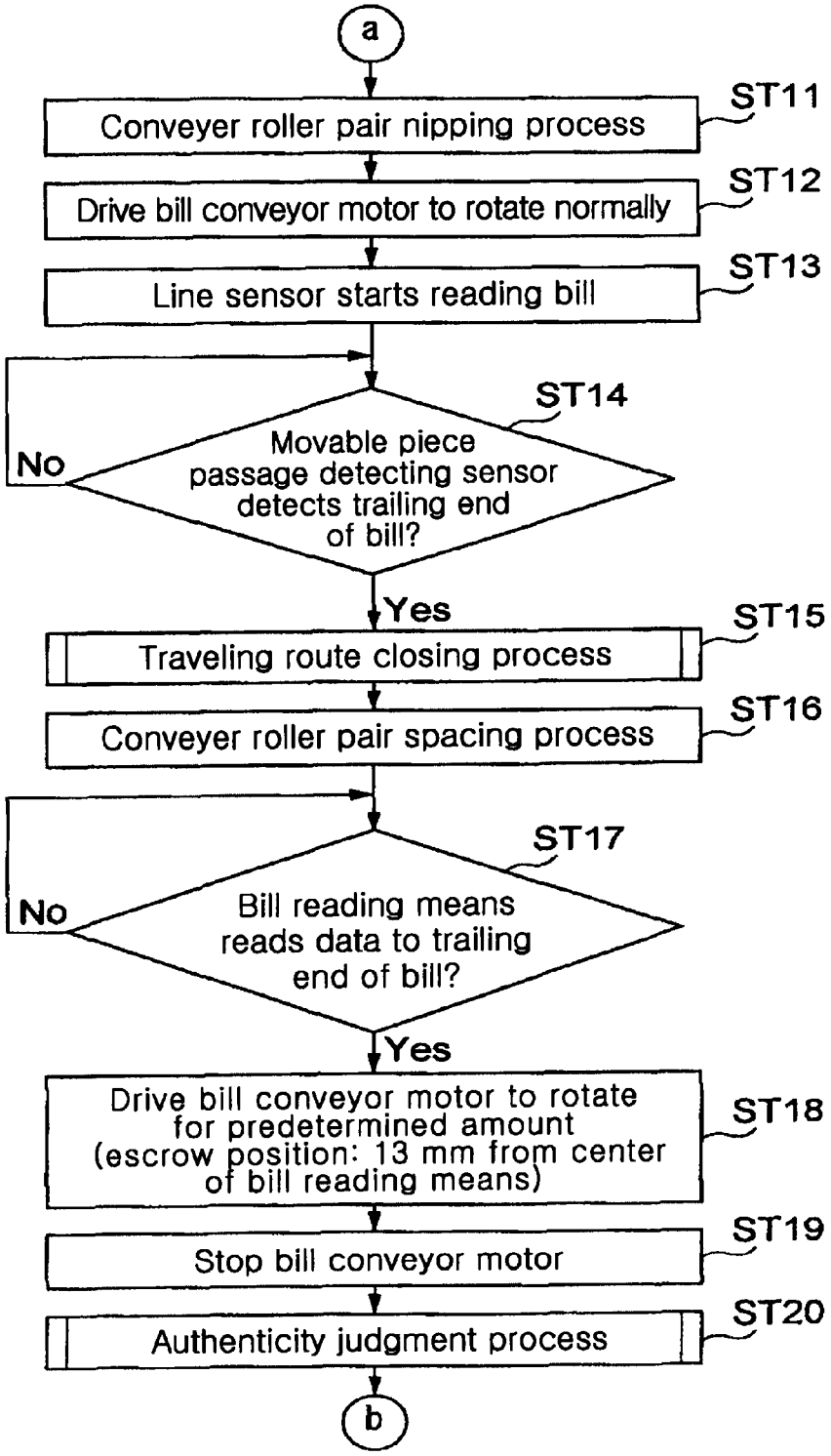
FIG. 10 shows a flowchart (part two) illustrating processing operations for processing the bill in the bill processing apparatus of this embodiment.
Figure 11:
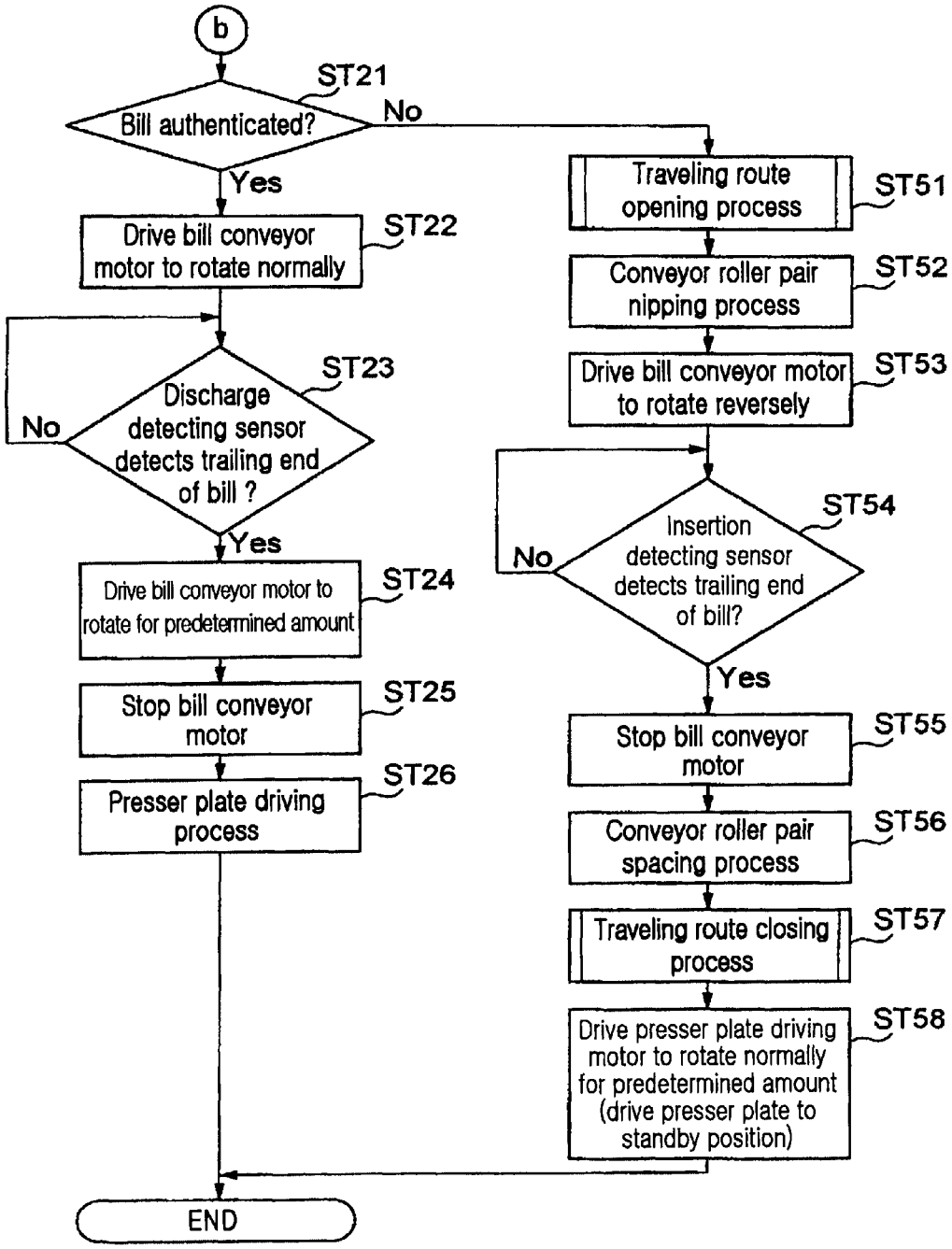
FIG. 11 shows a flowchart (part three) illustrating processing operations for processing the bill in the bill processing apparatus of this embodiment.
Figure 12:
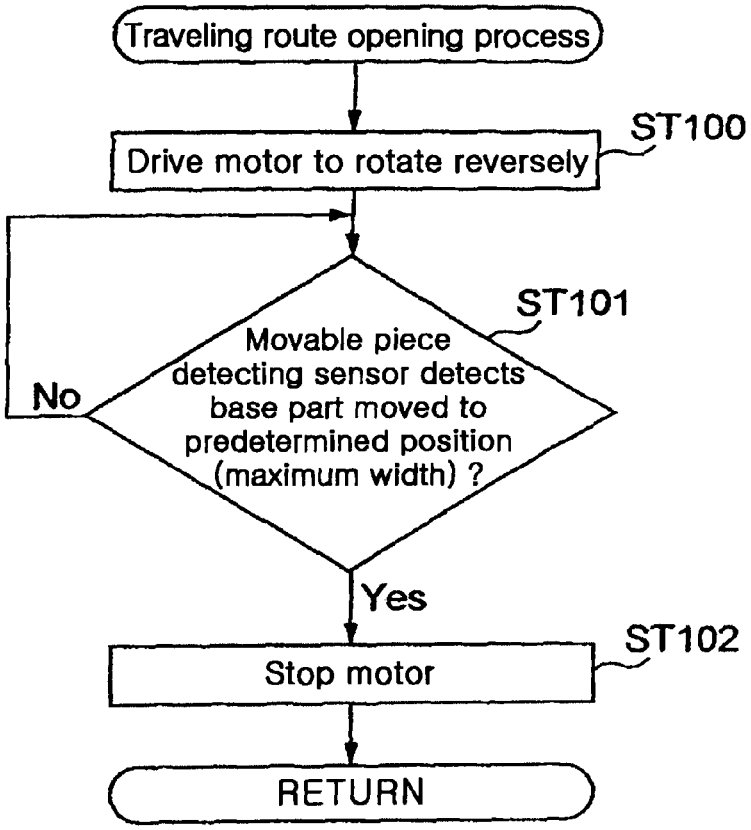
FIG. 12 shows a flowchart illustrating processing operations of a traveling route opening process.

In this way, by converting an image obtained by the line sensor into pixel information including color information having brightness by the converter, it becomes possible to perform an actual measurement of the printing lengths of the bill being conveyed. For example, as shown in FIG. 8, while the bill is conveyed (conveyance in the D1 direction), the detection of the bill is moved from the non-printed area to the printed area such that the brightness of the pixel information in the printed area may become low. Accordingly, provided that an average brightness of the pixel information in the width direction D2 is measured and that its displacing positions are detected by setting a threshold value, it is possible to acquire actual measurement data of the printing lengths R in predetermined areas (here, corresponding to the entire printed area along the longitudinal direction).

Therefore, the setting of a new reference value inherent in the bill processing apparatus is achieved by using a bill of a legitimate bill as a base and utilizing the actual measurement data of the bill that is obtained as stated above. This is what changes the reference value (reference value that determines a bill to be genuine) that relates to the print length of a bill that is pre-specified as a program, and such change of the reference value is achieved by the procedure given below.

A pre-specified reference value is set to a value that adds the allowable range that is allowed for a genuine bill to a theoretical value of a print length of a bill (the length of a genuine bill's print length). Here, in order to simplify the explanation, assuming the theoretical value of the print length of a bill is 100 (100 pixels), and the reference value (allowable value) is set to 102 pixels with an allowable range of 2 pixels for the actual measured result at the time of effecting reading of the inserted bill. In other words, in the bill reading means 8, if the result of the read process is 102 pixels, it is determined to be a legitimate bill, and if the result is 103 pixels or greater, an assumption is made to determined it to be a counterfeit bill.

In a bill processing apparatus in which a reference value is pre-set as a program in this manner, a legitimate bill (including an actual bill and white paper and the like according to the reference) is conveyed and processed prior to actually operating the apparatus, to calculate the actual measurement value. When acquiring an actual measurement that is, for example, 102 pixels, the likelihood of determining even a genuine bill as a counterfeit increases with a reference value prior to the change process. In other words, when the print length becomes longer due to an error at the time of printing, the actual measurement value may become 103 pixels or more thereby increasing the likelihood that a genuine bill is determined to be counterfeit.

A contributing factor to the actual measurement value being 102 pixels is thought to be mainly based on a conveyor roller manufacturing error (thought to be larger than the theoretical diameter), and when the diameter of a conveyor roller is bigger due to a manufacturing error, the feed amount for bills increases thereby also greatly displacing the actual measurement value.

Therefore, by performing a setting process for a new reference value based on the actual measurement value, the theoretical value of the print length of the genuine bill, and the reference value (allowable value) prior to the change process, it becomes possible to perform an authenticity judgment process that is suited to that apparatus. More specifically, changing to a new reference value can be done by following, for example, the equation below.

New reference value=(actual measurement value/theoretical value)×(pre-change reference value)

When explaining by a numerical example, because the actual measurement value is 102 pixels, the theoretical value is 100 pixels, and the pre-change reference value is 102 pixels, the new reference value becomes 104 pixels (rounding off to omit decimal points), and the reference value of the bill processing apparatus is set to be 104 pixels (overwrite process) because the genuine bill is processed prior to operating the apparatus.

As a result, in this bill processing apparatus, the likelihood that the bill is determined to be a counterfeit bill lowers even for a genuine bill thereby enabling authenticity judgment to be carried out accurately.

Moreover, the overwrite process described above may be performed at the time of adjustment and inspection which follows the manufacturing of the bill processing apparatus. For example, if there is a "white correction" as an adjustment and inspection item, then the overwrite process may be performed at the same time as the white correction process. The white correction process can be performed by conveying a white paper, more specifically, a white paper having a length that matches the print length of a formal bill (preferably a polymer of a material in which there is no fear of the dimensions changing), through the bill reading means 8. By reading the length of this white paper by the light receiving part 81*a* of the bill reading means 8, the actual measurement value can be obtained at the same time as the white correction process. In this case, if the bill processing apparatus is also configured to read paper sheet varieties having a bar code printed in addition to bills, then the white correction process and the reference value overwrite process can be performed by utilizing a sensor that reads bar codes (bar code sensor).

Furthermore, the example given above describes acquiring the actual measurement value by feeding a single bill (which may include a white paper); however, a plurality bills or white papers may also be fed after which an average of the acquired actual measurement values are acquired to calculate the new reference value as described above. In this manner, it becomes possible to measure the improvement in the adjustment accuracy by using the average value of actual measured values obtained from a plurality of sheets. Further, the example given above described when a reference value is a higher value (102 pixels) than the theoretical value, however, the reference value may also be determined by having a prescribed width (for example, 98~102 pixels) that has the theoretical value in the center.

Next, the bill processing operation in the bill processing apparatus 1 executed by the control means 200 will be described according to the flowcharts of FIGS. 9 to 15.

When an operator inserts a bill into the bill insertion slot 5, the conveyor roller pair (14A and 14B) installed in the vicinity of the bill insertion slot is in a state that the rollers are spaced from each other in an initial stage (refer to ST16 and ST56 to be described later). Further, with respect to the presser plate 115, the pair of link members 115*a* and 115*b* driving the presser plate 115 are located at the press standby part 108, and the presser plate 115 is positioned in the standby position such that the bill cannot be conveyed-in the press standby part 108 from the receiving port 103 by the pair of link members 115*a* and 115*b*. That is, in this state, the presser plate 115 is brought into the opening formed between the pair of regulatory members 110 such that the condition is so made as to prevent the bills stored in the bill housing part from being drawn out through the opening.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST15 and ST57 to be described later) so as to prevent the bill from being drawn out in the initial stage.

In the initial state of the above-described pair of conveyor rollers (14A and 14B), it is possible for the operator to easily insert even a bill having wrinkles into the paper sheet insertion slot 5. Then, when insertion of the bill is detected by the insertion detecting sensor 7 (ST01), the driving motor 20 of the above-described presser plate 115 is driven to rotate reversely for a predetermined amount (ST02) to move the presser plate 115 to the initial position. That is, the presser plate 115 is in a state that the presser plate 115 is moved and remains in the opening formed between the pair of regulatory members 110 such that it is so arranged that the bill cannot pass through the opening until the insertion of another bill is detected by the insertion detecting sensor 7.

When the presser plate 115 is moved from the standby position to the initial position, the press standby part 108 becomes in an open state (refer to FIG. 4) such that the apparatus is in a state that the bill can be conveyed into the bill housing part 100. That is, by driving the motor 20 to rotate reversely for a predetermined amount, the presser plate 115 is moved from the standby position to the initial position via the main body side gear train 21 and the presser plate driving mechanism 120 (the housing part side gear train 124, the rack formed on the movable member 122, and the link members 115*a*, 115*b*).

Further, the above-described roller up-and-down motor 70 is driven to move the upper conveyor roller 14A so as to make a contact with the lower conveyor roller 14B. In accordance therewith, the inserted bill is nipped and held therebetween by the pair of conveyor rollers (14A and 14B) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 12 (ST100). At this time, when it is detected that the pair of movable pieces 10A have moved to the predetermined positions (the maximum open width positions) by the movable piece detecting sensor (ST101), the driving operation to rotate the motor 40 reversely is stopped (ST102). This traveling route opening process makes the skew correction mechanism in such a condition as to allow the paper sheet to enter between the pair of movable pieces 10A. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is conveyed into the inside of the apparatus by the conveyor roller pair (14A and 14B), and when the movable piece passage detecting sensor 12 installed on the downstream side from the skew correction mechanism 10 detects the leading end of the bill, the bill conveyor motor 13 is stopped (ST06 and ST07). At this time, the bill is located between the pair of movable pieces 10A constituting the skew correction mechanism 10.

Subsequently, the above-described roller up-and-down motor 70 is driven to allow the conveyor roller pair (14A and 14B) holding the bill therebetween to become apart from each other (ST08). At this time, the bill is in a state that no load is applied.

Figure 13:
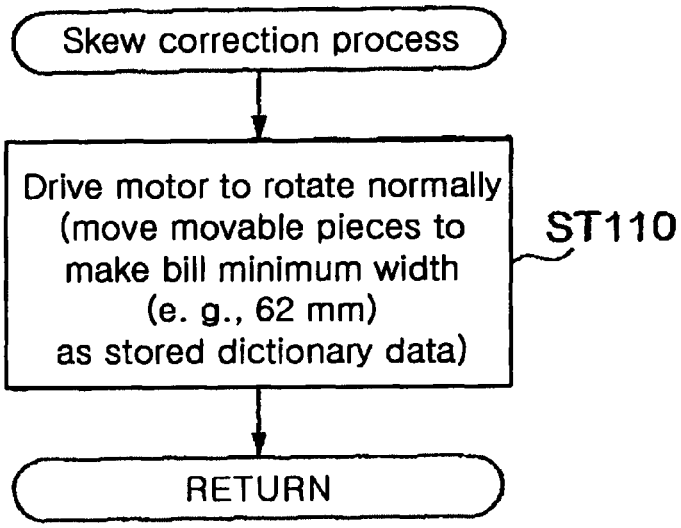
FIG. 13 shows a flowchart illustrating processing operations of a skew correction operating process.

Then, a skew correction operating process is executed as the paper sheet remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 13, the motor 40 described above is driven to rotate normally to move the pair of movable pieces 10A in respective directions such that the pair of movable pieces 10A get closer with each other (ST110). The movement of the movable pieces is continued until the distance therebetween becomes the minimum width (for example; width of 62 mm) of the bill registered in the reference data storage part in the control means. And the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 12).

Subsequently, the above-described roller up-and-down motor 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to convey the bill into the inside of the apparatus, and when the bill passes through the bill reading means 8, a reading process of the bill is executed (ST12 and ST13).

In the reading process of the bill, as shown in the timing diagram of FIG. 6, lighting control is performed such that the four light sources constituted of the transmitting light sources of the red light and the infrared light and the reflecting light sources of the red light and the infrared light in the above-mentioned first light emitting part 80*a* and the second light emitting parts 81*b* repeatedly turn on and off the lights with a constant interval, and two or more of the light sources do not simultaneously turn on the lights even without overlapping the on-phases of the respective light sources in any case. In other words, lighting control is performed such that, while any one light source is turned on, the other three light sources are turned off. Thereby, as described in this embodiment, it is possible even for the one light receiving part 81*a* to detect each light from each light source at a constant interval such that an image constituted of contrasting density data on a printed area of the identification object can be read out by a transmitted light and a reflected light of the red light and a transmitted light and a reflected light of the infrared light.

Figure 14:
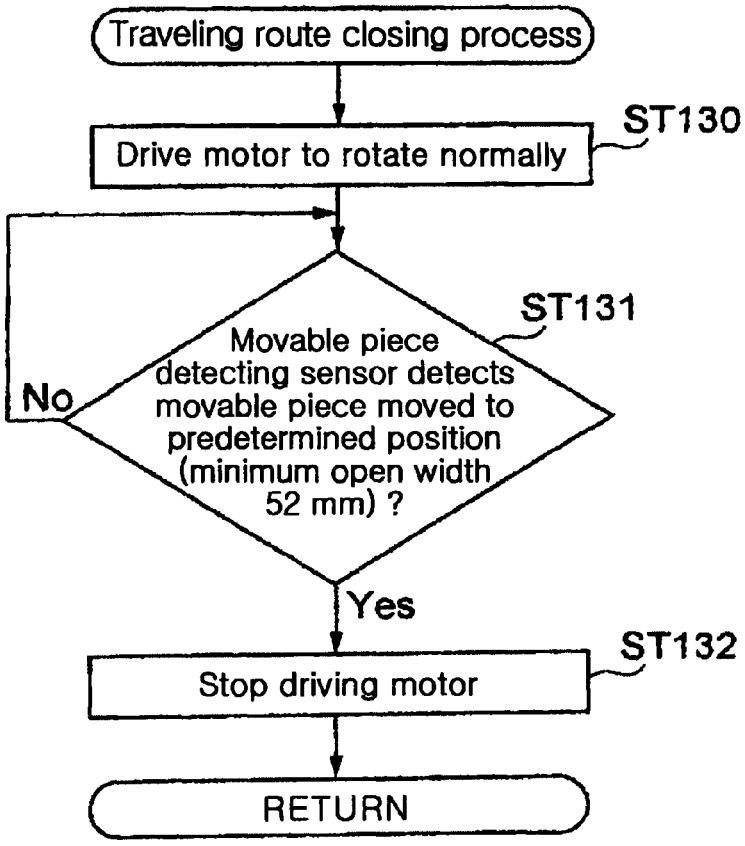
FIG. 14 shows a flowchart illustrating processing operations of a traveling route closing process.

Then, when the bill to be conveyed passes through the bill reading means 8, and the trailing end of the bill is detected by the movable piece detecting sensor 12 (ST14), a process for closing the bill traveling route 3 is executed (ST15). In this process, first, as shown in the flowchart of FIG. 14, after the trailing end of the bill is detected by the movable piece detecting sensor 12, the above-described motor 40 is driven to normally rotate to move the pair of movable pieces 10A in the directions that they get closer to each other (ST130). Next, when it is detected by the movable piece detecting sensor that the movable pieces 10A move to the predetermined positions (minimum open width positions: for example, width of 52 mm) (ST131), the driving operation of the normal rotation of the motor 40 is stopped (ST132).

With this traveling route closing process, the pair of movable pieces 10A are moved to the positions of the minimum open width (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In addition, when the movable piece detecting sensor as described above detects the movement of the movable pieces 10A in this state, it may be considered that the operator is committing some fraudulent activities such that a predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may blink, or without activating a process for input acceptance (ST22) input by another operator thereafter, a process in which a discharge operation or the like is forcibly conveyed out may be executed. Or, appropriate processes such as canceling the operation of the bill processing apparatus (for example, a process for stopping the processing, a process for discharging the bill, and the like) and the like may be executed.

Further, in succession to the traveling route closing process described above (ST15), a conveyor roller pair spacing process is executed such that the above-mentioned roller up-and-down motor 70 is driven to make the conveyor roller pair (14A, 14B) having been in a state capable of nipping and holding the bill therebetween separate from each other (ST16). By executing the conveyor roller pair spacing process, even if the operator additionally inserts (double insertion) another bill by mistake, the bill is not subject to a feeding operation by the conveyor roller pair (14A, 14B) and hits front ends of the pair of movable pieces 10A in a closed state according to ST15 such that it is possible to reliably prevent the operation of bill double-insertion.

Along with the bill traveling route closing process as mentioned above, when the bill reading means 8 reads the data up to the trailing end of the bill, the bill conveyor motor 13 is driven for a predetermined amount and stops the bill in a predetermined position (an escrow position; a position where the bill is conveyed toward the downstream by 13 mm from the center position of the bill reading means 8), and at this time, an authenticity judgment process of the bill is executed in the comparison judgment part 235 by referring to the reference data stored in the reference data storage part 233 in the authenticity judging part 230 of the aforementioned control means 200 (ST17 to ST20).

Figure 15:
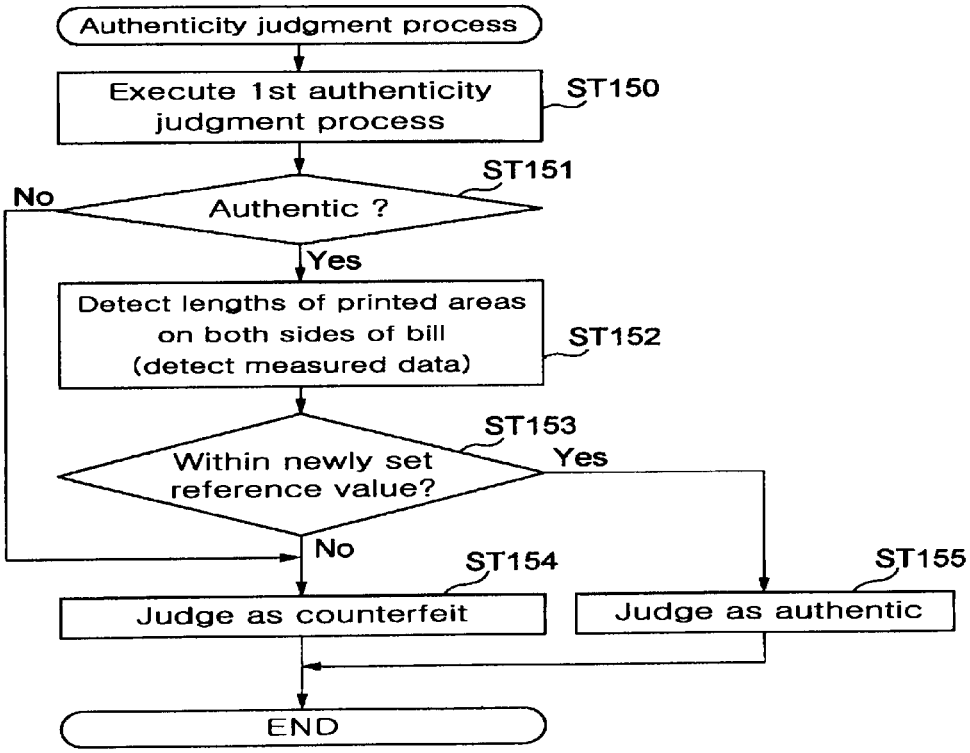
FIG. 15 shows a flowchart illustrating processing operations of a bill authenticity judgment process.

In this authenticity judgment process, first, as shown in a flowchart of FIG. 15, the aforementioned first authenticity judgment process is executed (ST150). In the case where the bill is judged as authentic in this first authenticity judgment process (ST151; Yes), the following second authenticity judgment process, i.e., an authenticity judgment process based on printing lengths is carried out, and in the case where the bill is judged as counterfeit in the first authenticity judgment process (ST151; No), the bill is judged as counterfeit without executing the second authenticity judgment process, to complete the process (ST154).

In the second authenticity judgment process, first, the lengths of the predetermined printed areas of the bill (actual measurement data) are detected by the bill reading means 8 (ST152). Subsequently, it is determined whether or not the actual measurement data is within a scope of a new reference value subject to re-writing process as mentioned above. In this case, if a new actual measurement value exists within the scope of the new reference value (ST153; Yes), the bill is judged as legitimate (ST155).

On the other hand, in the step of ST153, if the actual measurement value does not exist within the scope of the new reference value (ST153, No), the bill is judged as counterfeit (ST154).

As described above, by carrying out the authentic judgment process based on printing lengths of the printing area of the bill, it is possible to further improve the accuracy of the bill authenticity judgment, and even in a case where the conveyor roller has an manufacture error, it is possible to perform appropriately the authenticity judgment process.

Then, in the above-mentioned authenticity judgment process of the ST20, when the bill is judged as legitimate (ST21; Yes), the bill conveyor motor 13 is consecutively driven to rotate normally to convey the bill in this state toward the bill housing part 100 (ST22).

At the time of conveying the bill of processing ST22, the bill conveyor motor 13 is driven to rotate normally until the trailing end of the bill is detected by the discharge detecting sensor 18 (ST23), and after the trailing end of the bill is detected by the discharge detecting sensor 18, the bill conveyor motor 13 is driven to rotate normally for the predetermined amount (ST24 and ST25).

The process for driving the bill conveyor motor 13 to rotate normally in ST24 and ST25 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide it stably to the press standby part 108. That is, by further driving the bill conveyor motor 13 to rotate normally for a predetermined amount after the trailing end of the bill is detected by the discharge detecting sensor 18, the pair of belts 150 contact the bill conveyed-in and are driven in the feeding direction so as to guide the bill in a stable state to the press standby part 108.

Then, after the above-described bill conveyor motor 13 is stopped, the process for driving the presser plate 115 is executed (ST26) such that the bill is placed on the placing plate 105. And, after the pressing process is completed, the presser plate 115 is again moved to the standby position and stopped to the position.

Also, in the process of ST22 as described above, when the inserted bill is judged as a non-legitimate bill (ST21; No), a traveling route opening process is executed (ST51, refer to ST100 to ST102 of FIG. 12), then, the bill conveyor motor 13 is driven to rotate reversely, and the conveyor roller pair (14A and 14B) are brought into contact with each other such that the bill waiting at the escrow position is conveyed toward the bill insertion slot 5 (ST52 and ST53). Then, when the insertion detecting sensor 7 detects the trailing end of the bill to be returned toward the bill insertion slot 5 (ST54; Yes), the driving to reversely rotate the bill conveyor motor 13 is stopped, and above-described roller up-and-down motor 70 is driven to make the conveyor roller pair (14A and 14B) in a state of nipping and holding the bill therebetween separate from each other (ST55 to ST56). After that, the traveling route closing process is executed (refer to ST57, and ST130 to ST132 in FIG. 14) and the driving motor 20 for the presser plate 115 is driven to rotate normally (ST58) such that the presser plate 115 positioned at the initial position is driven to move to the standby position, and then a series of processes are completed.

According to the abovementioned configuration of the bill processing apparatus 1, since the authenticity judgment process based on printing lengths of the bill is executed, it is possible to make an attempt to improve the authenticity judgment accuracy, and at the time of executing such the authenticity judgment process based on printing lengths of the bill, even in a case where the conveyor roller has a dimensional error caused during a manufacturing process thereof, it is possible to accurately perform the authenticity judgment.

Figure 16:
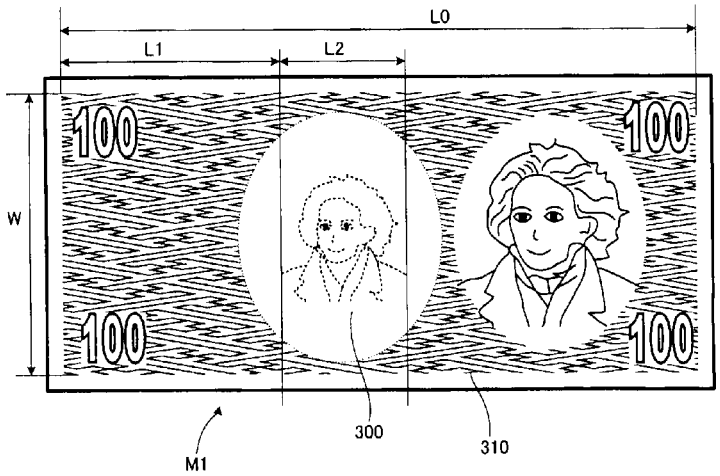
FIG. 16 is a schematic diagram illustrating locations of length data and an identification area of a printed area of the bill is acquired.

A bill is illustrated schematically in FIG. 16 to explain another embodiment. Bill M1 provides a length L0 of the printing area 310 of the traveling direction, and a width W of a printing area which is in the width-direction perpendicular to the traveling direction. Further, a watermark area 300 capable of determining the authenticity of a bill is provided in only the length of L2 in the traveling direction at a spot separated from the tip of the printing area by the length of L1 in the traveling direction of Bill M1. As has been stated above, the length L0 of print area 310 can be measured in units of pixels by the light receiving/emitting unit 81 of the bill reading means 8. For Bill M1, even if the theoretical value of the length L0 of print area 310 is 100 pixels, there is still a possibility that the actual measurement value is 102 pixels due to a manufacturing error or the like. Therefore, in this bill processing apparatus 1, an error will always occur when reading 100 as 102. Relative to the theoretical value being 100, in a case in which the 102 is used for the maximum allowable value, the new maximum allowable value becomes 102/100×102=104 (omitting fractions). Further, in a case in which 98 is used as the minimum allowable value, the new minimum allowable value becomes 102/100×98=99 (omitting fractions). Therefore, in a case in which 98 through 102 is pre-set as the theoretical allowable range, the new allowable range from 99 through 104 is newly set by the actual measurements as described above and will be used in place of the theoretical allowable range.

As can be understood from FIG. 16, the print area is not limited to the thickness along the entire width W of Bill M1. Nevertheless, if the brightness in the width W direction is measured and the average value or the like is taken, the start position and end position of print area 310 can accurately be read by setting a prescribed threshold value. Further, the reason the full length L0 of print area 310 is used in this manner is because a revision can be performed more accurately by the actual measurement. For example, when using the distance L1 from the start of the print area 310 until reaching the identification area 300, since L1 is roughly ⅓ of L0, the accuracy setting should also be the same at about roughly ⅓. Similarly, the absolute value of an error in the traveling direction in the identification area 300 becomes smaller according to the ratio relative to the length of L2 to L0; therefore, the impact on the authenticity judgment process is lessened.

In the embodiment given above, for example, when a pulse motor is used to drive a conveyor roller, it is normal to measure the pulse count (rotation angle of the motor units) to determine the convey distance of a bill. If N (pulse) is put out per one revolution (360 degrees), then 0.508/(n·D)×N (pulse) is necessary to convey 1 pixel (0.508 mm) using a conveyor roller of diameter D (mm). In other words, despite the theoretical value of the length L0 of print area 310 of Bill M1 being 100 pixels, indicating the actual measurement is 102 pixels is because the diameter of the conveyor roller, due to a manufacturing error or the like, is D r (actual diameter)=design value×(1−2/100). This means that the conveying distance as measured by the pulse count is longer by only 2/100 over the actual conveying distance. For example, in this type of a bill processing apparatus, even though originally the reference for the allowable range is from 98 through 102, the range for the new reference becomes 99 through 104. Therefore, for the case in which the actual measurement value of L0 is 103 or 98, the former (103) is within the allowable range for the new reference, however, the latter (98) is outside of the allowable range for the new reference.

Further, conversely, regardless if the theoretical value of the length L0 is 100 pixels, in the case the actual measurement is 98 pixels, the diameter of the conveyor roller can be assumed to be at Dr (actual diameter)=design value×(1+2/100), due to a manufacturing error or the like. For example, in this type of a bill processing apparatus, even though the original allowable range for the reference L0 is from 98 through 102, the range of the new will be set from 96 (=0.98×98; omitting fractions) through 99 (=0.98×102; omitting fractions). Therefore, for the case in which the actual measurement value of L0 is 103 or 98, the former (103) is outside the allowable range for the new reference, and the latter (98) is within the allowable range for the new reference. As stated above, systematical errors that accompany manufacturing errors in bill reading such as those described above are corrected, and an actual allowable range can be determined in place of the theoretical allowable range. Moreover, there are no "misalignments" caused by slippage between the conveyor roller and the bill.

Next, a correction of such an error by the line sensor will be described. A line sensor is a static part, and different from conveyors which deal with friction, there is no fear of mechanical "misalignment" in relation to the bill. Also, since there is no moving of the sensor itself, errors due to placement that accompany movement are also difficult to arise. Therefore, the width W of the printing area of the conveyed bill M can be assumed to be nearly error free. Accordingly, the printing area of bill M is pre-set to L0×W while it is understood that L0/W=2.00. In the bill M in FIG. 16, where the theoretical value is W=50 pixels and L0=100 pixels, the actual measurements are assumed to be W r=50 pixels and L0=102. From this assumption, it is understood that L0 has a diameter error. Therefore, with the original allowable range of the reference being from 98 through 102, the range of the new reference is set from 99 through 104. Moreover, it goes without saying that the allowable range of the width W at this time does not need to be changed.

For example, assume that where the theoretical value is W=50 pixels and L0=100 pixels, and the actual measurements are W r=52 pixels and L0=104. From this assumption, where W r is recognized as the actual length, the bill can be determined to be larger than the theoretical value. While it is not impossible for a diameter error to exist in the conveyor roller from L0, because L0/W=2.00 has been maintained, there is a possibility that the bill has been enlarged with a copier, and without even determining whether a new reference value is within or outside of the range, the bill can be judged to be counterfeit.

Further, the method for acquiring length data and areas (lengths) to be acquired as described above may be appropriately modified in consideration of the extent of the error, an accuracy required for the authenticity judgment, and so on. For example, the apparatus may be configured to acquire length data only on an area watermarked in the bill.

According to the configuration of the paper sheet processing apparatus, accurate authenticity judgment can be performed even if there is a manufacturing error in a conveyor member installed in each apparatus, because a reference value of the length of a paper sheet inherent in the apparatus is specified by, for example, reading a genuine paper sheet and calculating its length prior to operating the apparatus and using the read length.

Further, a paper sheet processing apparatus can be provided that includes an insertion slot where a paper sheet is inserted, a conveyor member that conveys a paper sheet inserted through the insertion slot, a light receiving/emitting unit that reads the paper sheet conveyed by the conveyor member, a storage part that stores in advance a reference value of the length in a prescribed area of the paper sheet and that stores an actual measurement value of the length in the prescribed area in the conveying direction of the paper sheet that was read by the light receiving/emitting unit, and a processor capable of controlling the conveyor member and the light emitting unit. At this time, the processor controls the conveying of the paper sheet by the conveyor member, reads the paper sheet by the light receiving/emitting unit in relation to the conveyed amount, measures the actual length of the prescribed area of the paper sheet by the light receiving/emitting unit and the conveying member, stores the actual measurement value in the storage unit, calculates a new allowable value based on the pre-stored reference value, the pre-set allowable value, and the actual measurement value, performs the first authenticity judgment of the paper sheet, and determines the authenticity by whether the actual measurement value is within the allowable range by comparing the actual measurement value of the prescribed area of the paper sheet with the new allowable value.

In addition, an authenticity judgment method can be provided by a paper sheet processing apparatus that includes an insertion slot where a paper sheet is inserted, a conveyor member that conveys the paper sheet inserted through the insertion slot, a light receiving/emitting unit that reads the paper sheet conveyed by the conveyor member, a storage part that stores in advance a reference value of the length in a prescribed area of the paper sheet and that stores an actual measurement value of the length in the prescribed area in the conveying direction of the paper sheet that was read by the light receiving/emitting unit, and a processor capable of controlling the conveyor member and the light emitting unit. This method enables the conveying of the paper sheet by the conveyor member, reading the paper sheet by the light receiving/emitting unit in relation to the conveyed amount, measuring the actual length of the prescribed area of the paper sheet by the light receiving/emitting unit and the conveying member, storing the actual measurement value in the storage unit, calculating a new allowable value based on the pre-stored reference value, the pre-set allowable value, and the actual measurement value, performing the first authenticity judgment of the paper sheet, and determining the authenticity by whether the actual measurement value is within the allowable range by comparing the actual measurement value of the prescribed area of the paper sheet with the new allowable value. Here, in the first authenticity judgment, light of differing wavelengths (for example, red light and infrared light) irradiates a bill by a plurality of light sources thereby enabling authenticity judgment to be performed by detecting and receiving transmitted light and reflected light, and analyzing the data of the received light. For example, the transmissivity and the reflectivity differ for reflected light reflected from a specified area and transmitted light that passes through a specified area of the bill, which enables this to also be used.

As mentioned above, the embodiment of the present invention is described. However, the present invention is not limited to the above-described embodiments, and various modifications of the present invention can be implemented.

As described above, the present invention is characterized in that length information (actual measurement data) is acquired in a predetermined area along the traveling direction of the conveyed bill, and that an altered reference value based on the legitimate bill is utilized prior to the operation of the apparatus if the authenticity identification of the bill is performed on the basis of the actual measurement data. Therefore, the concrete identification method in the first authenticity judgment process, the configuration of the bill reading means (which may be another configuration than the line sensor), and the mechanisms for driving the various types of driving members may be appropriately modified.

According to the present invention, a bill processing apparatus which is capable of carrying out accurately an authenticity judgment of a bill can be provided, even if the apparatus has a dimensional error during a manufacturing thereof, without any influences by the dimensional error.

The present invention can be incorporated, for example, into various types of apparatuses to provide products and services by inserting a bill thereinto and into a device to provide merchandises and services by inserting a paper sheet.

What is claimed is:

1. A sheet processing apparatus comprising:

an insertion slot into which a sheet is inserted, the sheet including a printed area and a non-printed area on each side of the sheet;

a conveyor member which conveys the sheet inserted into the insertion slot;

a sheet reading unit which reads the sheet conveyed by the conveyor member;

a detection unit which detects an actual measurement value of length in the printed area along a traveling direction of the sheet being read by the sheet reading unit;

a storage part which stores a reference value of length in the printed area of the sheet; and an authenticity judgment part which judges an authenticity of the sheet based on a comparison result of the actual measurement value and the reference value, wherein the reference value is determined based on a calculated length as the length in the printed area is calculated by reading a legitimate sheet; a theoretical value of length of the printed area of the legitimate sheet; and a tolerance as an acceptable value in a legitimate sheet with respect to the theoretical value, and the reference value is changed by using the legitimate sheet as a base and utilizing the actual measurement value of length of the legitimate sheet to achieve a new reference value inherent in the processing apparatus.

2. A sheet processing apparatus comprising:

an insertion slot into which a sheet including a printed area and a non-printed area on each side of the sheet is inserted; a conveyor member which conveys the sheet inserted into the insertion slot;

a light receiving/emitting unit which reads the sheet conveyed by the conveyor member;

a storage part which stores in advance a reference value of length in the printed area of the sheet, and an actual measurement value of length in the printed area along a traveling direction of the sheet read by the light receiving/emitting unit; and a processor capable of controlling the conveyor member and the light receiving/emitting unit, wherein the processor is operative to:

control conveyance of the sheet by the conveyor member;

allow the light receiving/emitting unit to read the sheet in association with an amount of conveyance;

allow the storage part to store the actual measurement value of length in the printed area of the sheet, the actual measurement value of length being actually measured by the light receiving/emitting unit and the conveyance member;

calculate a new tolerant value based on the reference value stored in advance, a predetermined tolerant value, and the actual measurement value;

determine whether or not the actual measurement value is within an acceptable range by comparing the actual measurement value of the printed area of the sheet and the new tolerant value; and change the reference value by using the legitimate sheet as a base and utilizing the actual measurement value of length of the legitimate sheet to achieve a new reference value inherent in the processing apparatus.

3. An authenticity judgment method by a sheet processing apparatus comprising: an insertion slot into which a sheet including a printed area and a non-printed area on each side of the sheet is inserted; a conveyor member which conveys the sheet inserted into the insertion slot; a light receiving/emitting unit which reads the sheet conveyed by the conveyor member; a storage part which stores in advance a reference value of length in the printed area of the sheet, and an actual measurement value of length in the printed area along a traveling direction of the sheet read by the light receiving/emitting unit; and a processor capable of controlling the conveyor member and the light receiving/emitting unit, the method comprising:

conveying the sheet with the conveyor member;

reading the sheet with the light receiving/emitting unit in association with an amount of conveyance by the conveyance member;

obtaining the actual measurement value of length by actually measuring length in the printed area of the sheet with the light receiving/emitting unit and the conveyor member;

calculating a new tolerant value based on the reference value stored in advance, a predetermined tolerant value, and the actual measurement value;

comparing the actual measurement value in the printed area of the sheet and the new tolerant value when the sheet is judged as legitimate; and determining an authenticity by judging whether the actual measurement value is within a tolerant range or not, wherein the reference value is changed by using the legitimate sheet as a base and utilizing the actual measurement value of length of the legitimate sheet to achieve a new reference value inherent in the processing apparatus.

* * * * *